US007296942B2

(12) United States Patent
Mayne

(10) Patent No.: US 7,296,942 B2
(45) Date of Patent: Nov. 20, 2007

(54) WRITING INSTRUMENT

(76) Inventor: Geoffrey Peter Mayne, 164 Somerset Road, Handsworth Birmingham B20 2J0 (GB)

( * ) Notice: Subject to any disclaimer, the term of this patent is extended or adjusted under 35 U.S.C. 154(b) by 0 days.

(21) Appl. No.: 10/545,876

(22) PCT Filed: Jan. 23, 2004

(86) PCT No.: PCT/GB2004/000289

§ 371 (c)(1),
(2), (4) Date: Aug. 17, 2005

(87) PCT Pub. No.: WO2004/074002

PCT Pub. Date: Sep. 2, 2004

(65) Prior Publication Data

US 2006/0171762 A1 Aug. 3, 2006

(51) Int. Cl.
*B43K 7/12* (2006.01)
*B43K 5/16* (2006.01)

(52) U.S. Cl. ..... 401/117; 401/115

(58) Field of Classification Search ..... 401/99, 401/115, 117, 109
See application file for complete search history.

(56) References Cited

U.S. PATENT DOCUMENTS 2,605,746 A 8/1952 Kahn et al.
2,757,639 A * 8/1956 Wichmann ..... 401/115
2,870,741 A * 1/1959 Kersten ..... 401/100
4,469,462 A 9/1984 Hashimoto et al.
6,585,441 B1 * 7/2003 Shamitoff ..... 401/115

FOREIGN PATENT DOCUMENTS

| | | |
|---|---|---|
| DE | 52733 | 12/1889 |
| FR | 1 100962 | 9/1955 |
| FR | 1 127 686 A | 12/1956 |

OTHER PUBLICATIONS

British Search Report for British Application No. GB 0303670.4; Date of Search Mar. 17, 2003.
International Search Report for PCT Application No. PCT/GB2004/000289; Filed Jan. 23, 2004; Date of Completion May 3, 2004; Date of Mailing Jul. 1, 2004.

* cited by examiner

*Primary Examiner*—David J. Walczak
(74) *Attorney, Agent, or Firm*—Alston & Bird LLP

(57) ABSTRACT

A ball point pen has a retractable ink container (13) and writing tip (12) that are releasably held in the extended position by a locking element (19) freely movable in a transparent enclosure (18) at the remote end of the barrel (11). The locking element (19) may have the appearance of a football or golf ball. In another embodiment the locking element is elongated and has flat sides that may carry advertising or promotional markings.

10 Claims, 8 Drawing Sheets

WRITING INSTRUMENT

BACKGROUND OF THE INVENTION

This invention relates to an improved writing instrument of the kind having a writing tip, such as a ball point, at one end of a writing fluid chamber, the chamber and tip being retractable into a barrel or housing of the instrument when it is not in use to prevent inadvertent marking e.g. of hands or clothing. To write with the instrument the tip and chamber are moved relative to the barrel until the tip projects from one end of the barrel, releasable locking means being used to hold the tip in the extended position.

An object of the present invention is to provide a mechanism for such a writing instrument which is attractive and fun to use and which lends itself to the display of advertising or promotional material.

BRIEF SUMMARY OF THE INVENTION

In accordance with the present invention there is provided a writing instrument comprising a barrel, a writing fluid container moveable axially of the barrel whereby a writing tip of the container can be projected from or withdrawn into one end of the barrel, spring means biasing the container to the withdrawn position, a trigger extending from the container and projecting through an opening in the barrel whereby the container can be moved against the action of the spring to the projected position and means for releasably holding the container in the projected position, said holding means comprising a locking element which is freely moveable within an enclosure at the other end of the barrel, the enclosure having a shape such that said element may be interposed between the container and a component of the enclosure to hold the container in the projected position in a first position of said element and is displaceable under gravity or by inertia transversely of the enclosure to a second position, when released from the influence of the spring means by actuation of the trigger, in which second position said element does not prevent movement of the container to the withdrawn position.

Preferably the enclosure is transparent.

In one embodiment of the invention stop means projects inwardly of one side of the enclosure and the container has at its end remote from the tip a plunger from which the trigger extends, the plunger having a flange or lip extending upwardly in a lengthwise direction of the enclosure on the opposite side of the latter to the stop means, the locking element being dimensioned to pass the stop means except when held by the spring means between the latter and the flange or lip.

Preferably the stop means is intermediate the ends of the enclosure and on the side of the stop means remote from the plunger is a compartment of the enclosure in which the locking element is freely moveable.

The locking element is preferably of a rounded configuration and may be generally spherical.

The enclosure may be an enlargement of said other end of the barrel.

In another embodiment of the invention the locking element is elongated axially of the enclosure; one end of the latter being stepped and the arrangement is such that with the locking element between the container and the step of the enclosure the spring means is unable to move the container to the withdrawn position.

The locking element may be pivotable at one end and moveable transversely of the enclosure at its other end.

The locking element may have a relatively larger, rounded end in contact with a plunger at the end of the container remote from the tip and a relatively thinner end for engaging the step, the arrangement being such that with the plunger drawn against the spring means the locking element is able to rock on the plunger to align its thinner end with, the step.

Alternatively said step may be provided on a plunger at the end of the container remote from the tip and the locking element may have a relatively thicker end which is pivotally mounted at the end of the enclosure remote from the plunger and a relatively thinner end which can be moved across the enclosure between positions aligned with or not aligned with the step.

In yet another embodiment of the invention the trigger extends from a plunger at the end of the container remote from the tips the plunger being a sliding fit within a first compartment of the enclosure, said first compartment communicating with a second compartment of the enclosure offset laterally from the first compartment and the locking element being displaceable under gravity or inertia between the compartments when the plunger is moved to compress the spring, the arrangement being such that when the locking element occupies the first compartment it prevents withdrawal of the container and such that when the locking element occupies the second compartment the spring means may move the container to its withdrawn position. In this embodiment the locking element is preferably in the form of a ball.

The end of the plunger remote from the container is preferably chamfered to prevent escape of the locking element from the first compartment when the container is held in the projecting position.

BRIEF DESCRIPTION OF THE DRAWINGS

Preferred embodiments of the present invention will now be described with reference to the accompanying drawings, in which.

DETAILED DESCRIPTION OF PREFERRED EMBODIMENTS

Figure 1:
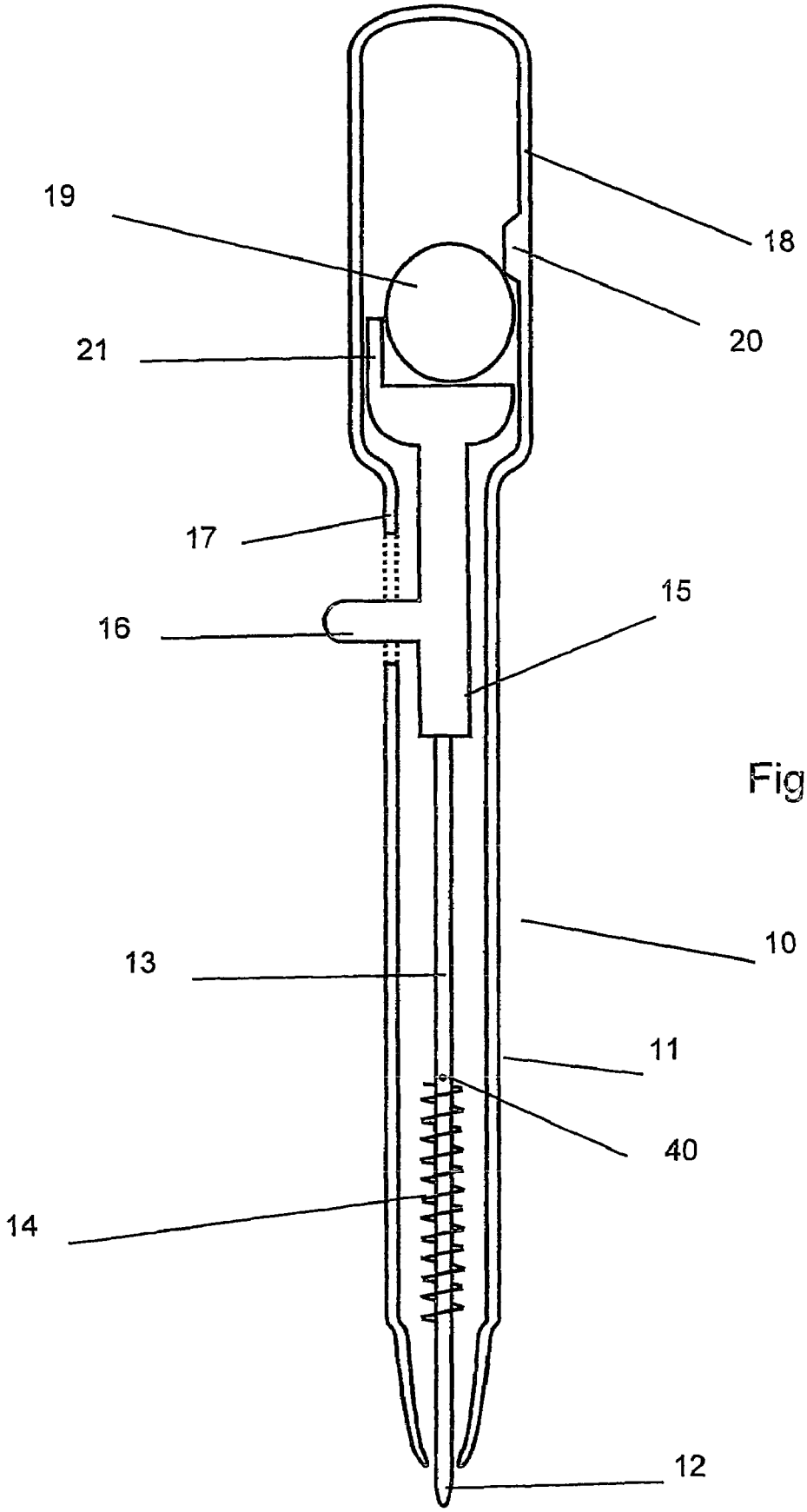
FIG. 1 is a sectional elevation of a first embodiment of a writing instrument in accordance with the invention, showing the writing tip extended.
Figure 2:
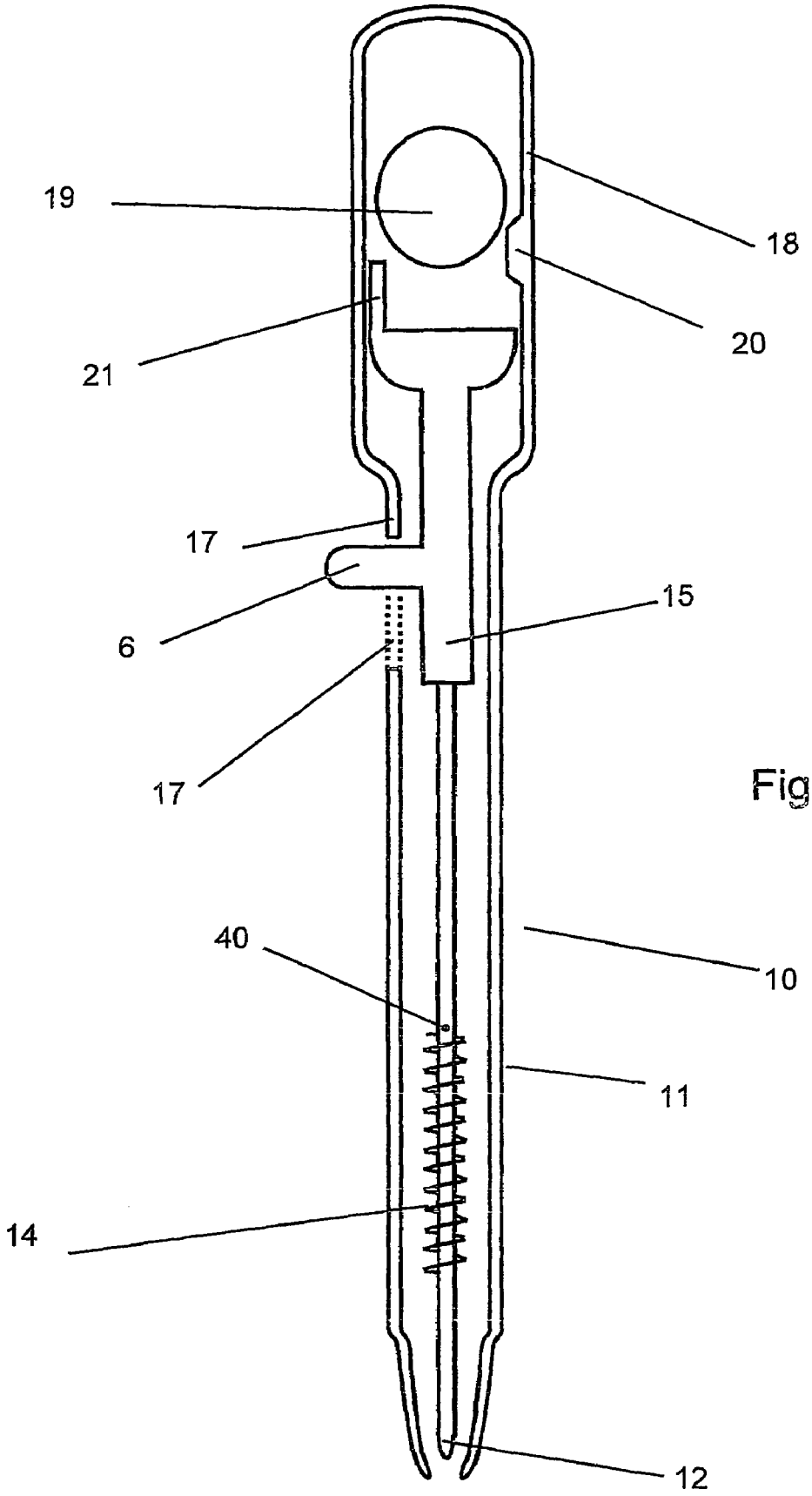
FIG. 2 is a similar view of the writing instrument of FIG. 1 but showing the writing tip retracted.

The writing instrument 10 shown in FIGS. 1 and 2 has a barrel 11 from one end of which a writing tip 12 of an ink container 13 can project, the container with its tip being biased by a compression spring 14 acting between the barrel and a stop 40 on the container 13 to retract the container 13 and its tip 12 into the barrel 11 (FIG. 2). Alternatively the spring 14 may extend throughout the length of the container 13 and act on the underside of a plunger 15 integral with the end of the container 13 remote from its tip 12. Projecting from the plunger 15 is an integral trigger or latch 16. This extends out of the barrel 11 through a slot 17 which is elongated axially of the barrel 11 sufficiently to allow the trigger 16 to be moved against the action of spring 14 against the stop until the tip 12 is extended from the barrel 11.

At the end of the barrel 11 remote from the tip 12 is a transparent enlargement 18 providing an enclosure for a spherical locking element or ball 19 which is freely moveable throughout the enclosure. Midway along the length of the enclosure a stop 20 projects inwardly of the enclosure. A lip or flange 21 projects into the enclosure from the plunger 15 on the side of the enclosure remote from the stop 20, the dimensions of these components being such that the ball 19 can pass the stop 20 if not in contact with the flange 21, but such that if the ball 19 is trapped between the flange 21 and the stop 20 it will prevent movement of the plunger 15 inwardly of the enclosure.

If desired only part of the enlargement may be transparent, such that the ball 19 is visible only in one of it two positions. Transparency may be provided by a temperature sensitive material such that the interior of the enclosure is visible only when the enclosure is heated by being held in the hand, at other times being opaque.

To allow the tip 12 to be retracted into the barrel 11 the trigger 16 is first depressed against the spring 14 sufficiently to allow the ball 19 to pass the stop 20. The writing instrument can if necessary be inverted and/or shaken until the ball 19 rolls by gravity or through inertia into the upper compartment of the enclosure above the stop 20 as shown in FIG. 2. The spring 14 is now able to move the plunger 15 inwardly of the enclosure 18 until the writing tip 12 is retracted (FIG. 2).

To reverse this sequence the instrument 10 is held upright while the trigger 16 is depressed sufficiently to allow the ball 19 to fall past the stop 20. When the trigger 16 is now released the ball 19 will become trapped between the flange 21 and the stop 20, holding the tip 12 in its extended position.

The ball 19 may be shaped and marked to resemble a football, a golf ball, a cricket ball or any other sporting ball. The ball and/or other components of the writing instrument may carry markings identifying a particular sporting club, society or side so that the instrument can be used as an advertising and promotional item as well as a novelty item.

Figure 3:
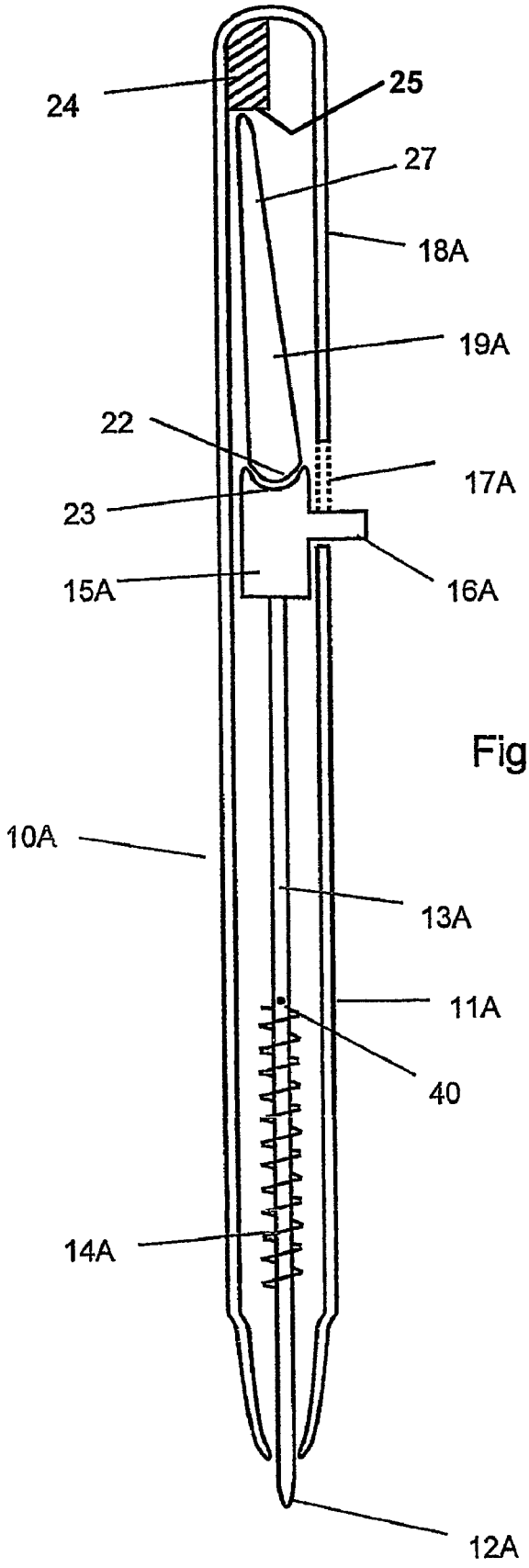
FIG. 3 is a sectional elevation of a second embodiment of a writing instrument in accordance with the invention showing the writing tip in the extended position.
Figure 4:
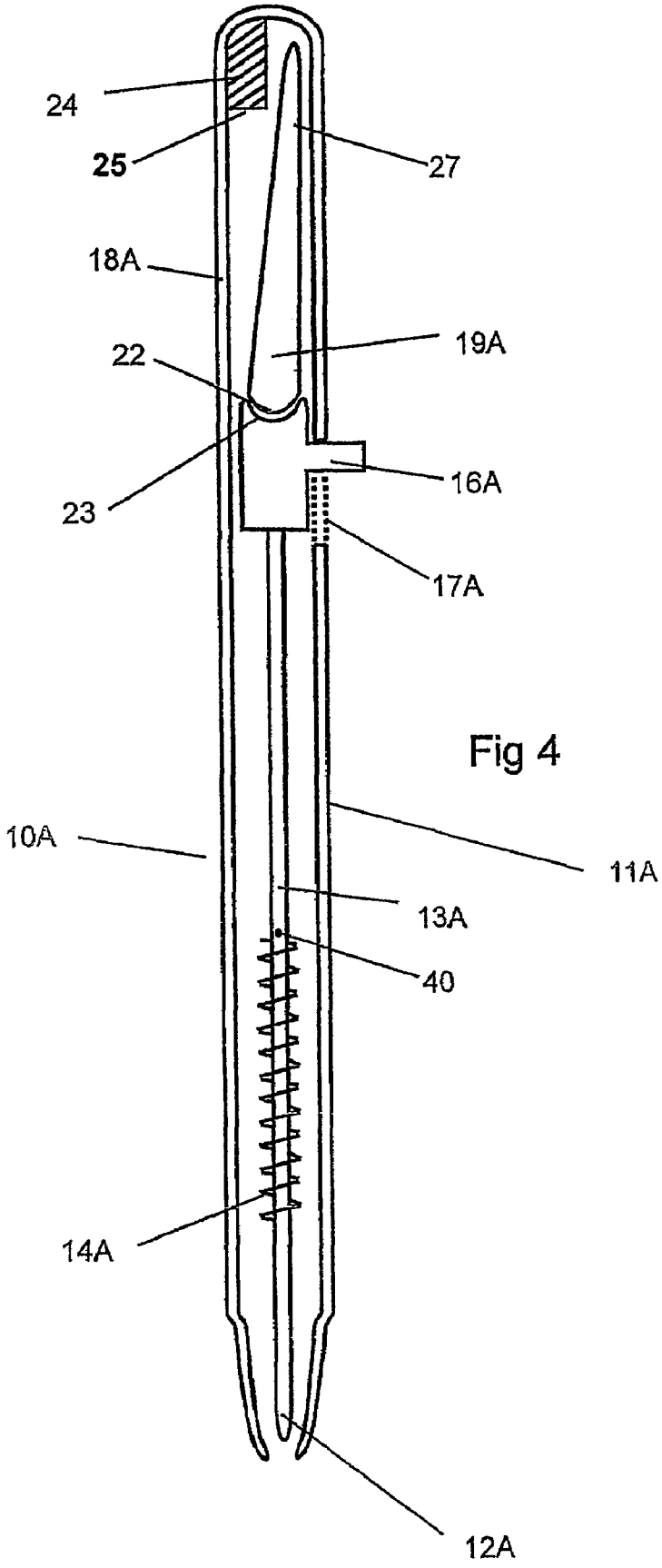
FIG. 4 is a view similar to that of FIG. 3 but showing the writing tip in the retracted position.

In the alternative embodiment of the present invention illustrated in FIGS. 3 and 4 a writing instrument 10A has a barrel 11A from one end of which the tip 12A of an ink container 13A may extend. At the end of the container 13A remote from the tip 12A it is integral with a plunger 15A from which a trigger or latch 16A projects out of the barrel 11A through a slot 17A. A spring 14A biases the plunger 15A and container 13A to the retracted position of the tip 12A (FIG. 4).

In this embodiment however the locking element 19A is not spherical but is elongated and lies within a transparent enclosure 18A at the end of the barrel 11A remote from the tip 12A. The locking element 19A is flat-sided and has a thicker, rounded end 22 resting in a groove 23 in the facing end of the plunger 15A. Within the enclosure 18A at a position remote from the plunger 15A is a block 24 which only partly extends across the enclosure thus providing a step 25 which can be selectively confronted by the narrower end 27 of the locking element 19A.

In use of the instrument of FIGS. 3 and 4, to retract the tip 12A from the position of FIG. 3 to the position of FIG. 4 first the trigger 16A is depressed sufficiently to free the locking member 19A. This can then be moved across the enclosure 18A, rotating on its rounded end 22, until its narrower end 27 comes out of alignment with the step 25. This can be achieved either by shaking the instrument, so that the locking element 19A is moved by inertia, or by holding the instrument horizontally so that the locking element 19A moves to its new position under gravity. When the trigger 16A is now released the spring 14A can raise the plunger 15A until the trigger 16A abuts the upper end of the slot 17A, defining the retracted position of the tip 12A into the barrel 11A (FIG. 4). To extend the tip 12A again the trigger 16A is depressed sufficiently to allow the locking member 19A to move back across the enclosure 18A until its narrower end 27 is aligned with the step 25, this again being achieved by gravity or inertia When the trigger 16A is now released the locking member 19A jams between the plunger 15A and the step 25, holding the tip 12A in its extended position.

Figure 5:
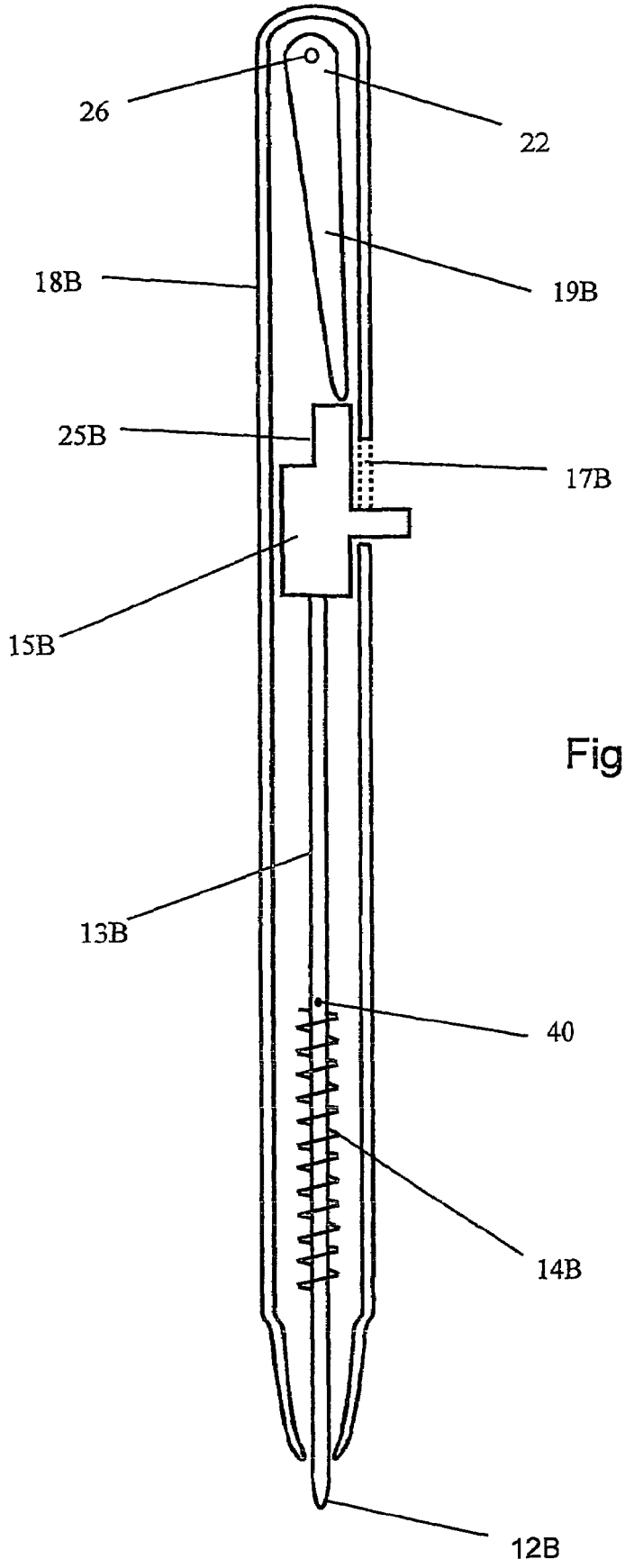
FIG. 5 is a sectional elevation of a third embodiment of a writing instrument in accordance with the invention showing the writing tip in the extended position.
Figure 6:
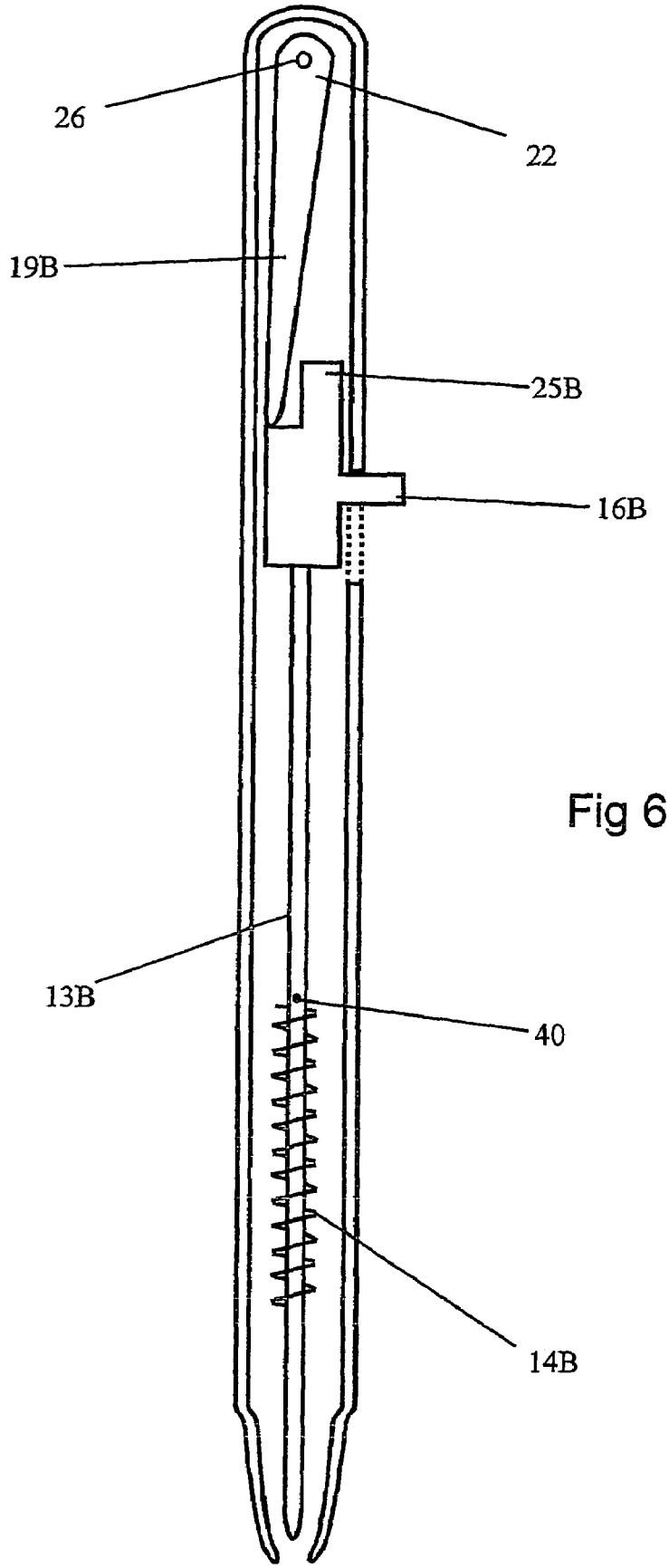
FIG. 6 is a view similar to FIG. 5 but showing the writing tip in the retracted position.

The writing instrument of FIGS. 5 and 6 has a locking system which is effectively an inversion of that of FIGS. 3 and 4. The elongated and tapered locking element 19B has a thicker, rounded end 22B at the end of the enclosure 18B remote from the ink container 13B. Preferably the locking element 19B is pivoted by a pin 26 spanning the enclosure 18B. The end of the plunger 15B presented to the locking element 19B is stepped as at 25B. When the thinner end of the locking element 19B is aligned with the step 25B the writing tip 12B is held in the extended position. When not aligned with the step 25B (FIG. 6) the container 13B can be moved by the spring 14B to the retracted position.

Either or both of the flat sides of the locking element 19A or 19B may be marked with advertising or promotional material.

Figure 7:
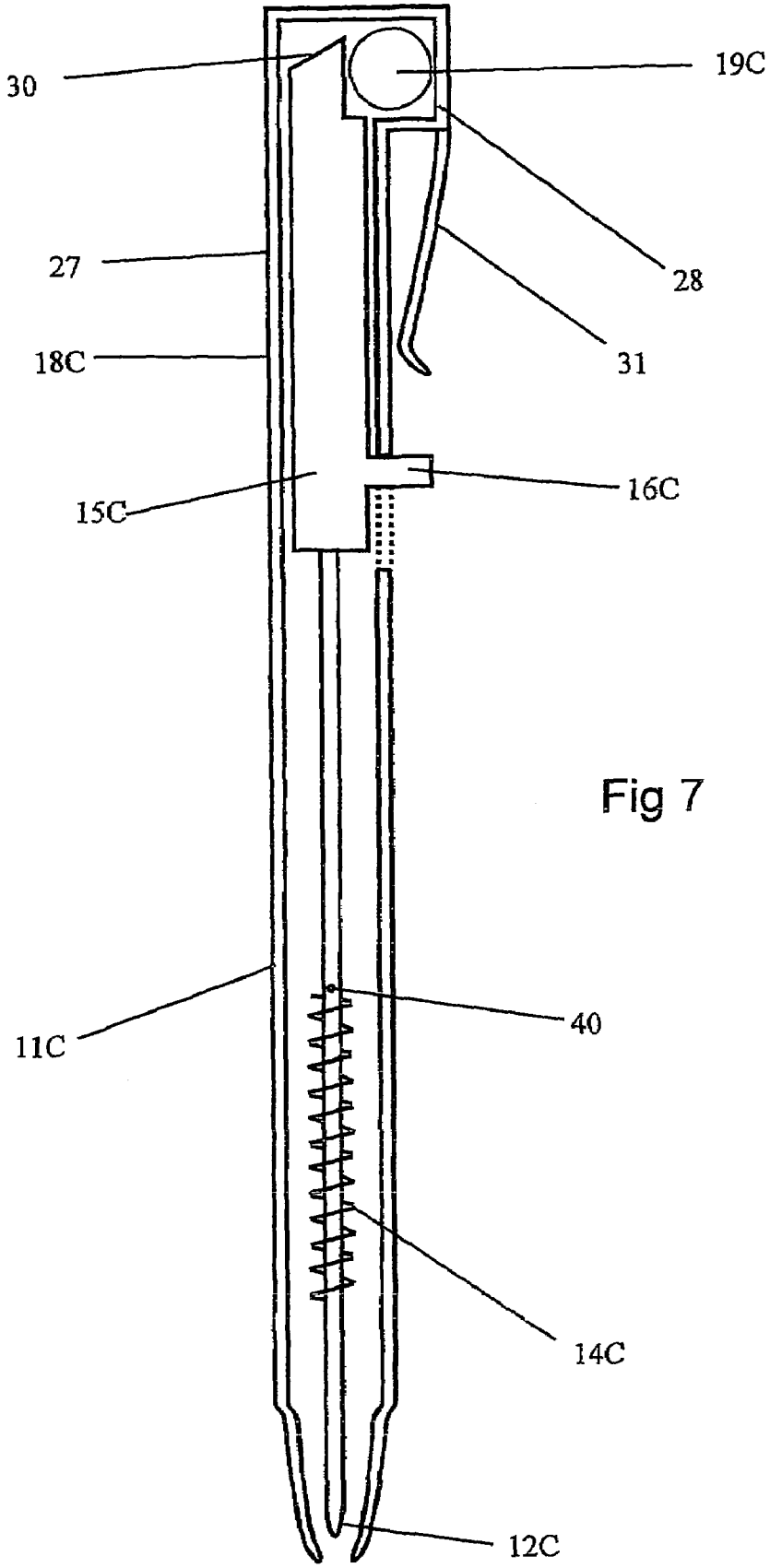
FIG. 7 is a sectional elevation of a fourth embodiment of a writing instrument in accordance with the invention showing the writing tip in the retracted position.
Figure 8:
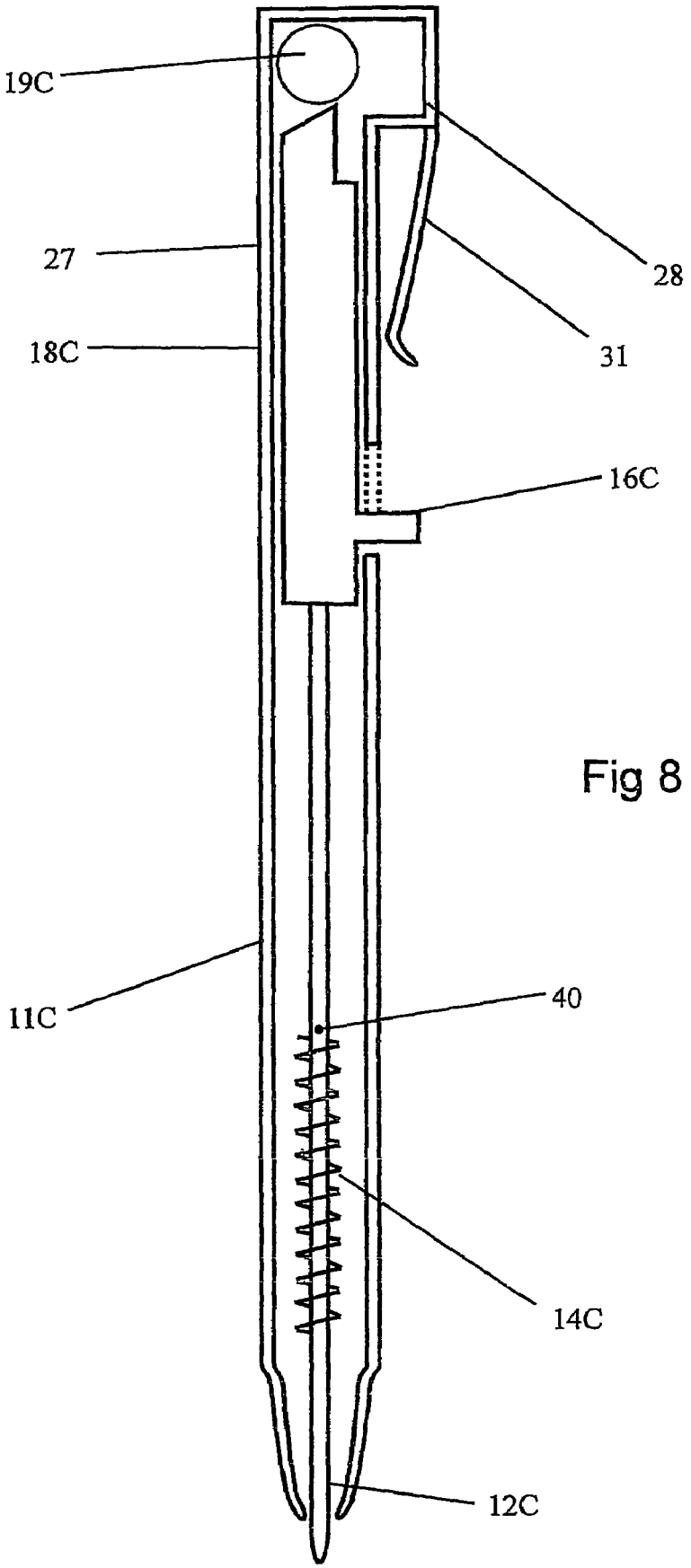
FIG. 8 is a view similar to FIG. 7 but showing the writing tip in the extended position.

In the embodiment of FIGS. 7 and 8 the enclosure 18C has a first compartment 27 in which the plunger 15C is a sliding fit and a second compartment 28 offset from the first compartment and communicating therewith at the upper end of the writing instrument. A locking element in the form of a ball 19C is free to move transversely of the enclosure 18C between the compartments 27 and 28 when freed to do so by the plunger 15C. To project the writing tip 12C from the barrel 11C the trigger 16C is depressed, compressing the spring 14C. Once the plunger 15C has moved out of alignment with the compartment 28 the ball 19C is free to roll across from the position of FIG. 7 to the position of FIG. 8, this being achieved either by "flipping" the instrument so that the ball moves relatively by inertia or turning it until the ball 19C moves under gravity. When the trigger 16C is now released the ball 19C is trapped between the plunger 15C and the top of the enclosure 18C by the spring 14C. To enhance this effect and prevent accidental dislodgement of the ball 19C the top end 30 of the plunger 15C is preferably chamfered as shown.

In this embodiment the "overhang" provided by the compartment 28 is used as the root of a pocket clip 31 for the instrument.

For the avoidance of doubt, "writing instrument" and "writing fluid" as used herein and in the appended claims are intended to embrace instruments and fluids used for any graphic purpose and not merely the formation of lettering.

The invention claimed is:

1. A writing instrument comprising a barrel, a writing fluid container moveable in an axial direction of the barrel whereby a writing tip of the container can be projected from or withdrawn into one end of the barrel, a spring exerting a force biasing the container to the withdrawn position, a trigger extending from the container and projecting through an opening in the barrel whereby the container can be moved against the force of the spring to the projected position, and a mechanism for releasably holding the container in the projected position, said holding mechanism comprising a locking element located within an enclosure at the other end of the barrel, the locking element having a height in the axial direction, wherein the locking element and enclosure are configured such that when the writing tip is in the withdrawn position the locking element is disposed within a portion of the enclosure having a depth in the axial direction that is greater than the height of the locking element and the locking element is freely movable over said depth, and when the writing tip is in the projected position the locking element may be immobilized to hold the writing tip in said projected position.

2. A writing instrument as claimed in claim 1, wherein the enclosure is transparent.

3. A writing instrument as claimed in claim 1, further comprising stop means that projects inwardly of one side of the enclosure, and wherein the container has at its end remote from the tip a plunger from which the trigger extends, the plunger having a flange or lip extending upwardly in a lengthwise direction of the enclosure on an opposite side of the enclosure from the stop means, the locking element being dimensioned to pass the stop means except when held by the spring between the stop means and the flange or lip.

4. A writing instrument as claimed in claim 3, wherein the stop means is intermediate the ends of the enclosure and on the side of the stop means remote from the plunger is the chamber of the enclosure in which the locking element is freely moveable.

5. A writing instrument as claimed in claim 3, wherein the locking element is of a rounded configuration.

6. A writing instrument as claimed in claim 5, wherein the locking element is generally spherical.

7. A writing instrument as claimed in claim 3 wherein the enclosure is an enlargement of said other end of the barrel.

8. A writing instrument as claimed in claim 1, wherein the locking element is elongated axially of the enclosure, one end of the enclosure defining a step and the writing instrument being structured and arranged such that with the locking element between the container and the step of the enclosure the spring is unable to move the container to the withdrawn position.

9. A writing instrument comprising a writing tip movable in an axial direction between a furthest retracted position and an extended position, and further comprising a locking element having a height in the axial direction and arranged for selectively locking the writing tip in the extended position, wherein when the writing tip is in the furthest retracted position the locking element is disposed within an enclosure having a depth in the axial direction that is greater than the height of the locking element and the locking element is freely movable over said depth.

10. A writing instrument comprising a barrel and a writing tip movable within the barrel in an axial direction between a retracted position and an extended position, and further comprising a locking element having a height in the axial direction and arranged for selectively locking the writing tip in the extended position, wherein when the writing tip is in the retracted position the locking element is disposed within a portion of an enclosure at one end of the barrel, said portion of the enclosure being defined between an end wall of the enclosure and a stop projecting laterally into the enclosure, said portion of the enclosure having a depth in the axial direction that is greater than the height of the locking element and the locking element being freely movable over said depth.

* * * * *

UNITED STATES PATENT AND TRADEMARK OFFICE

CERTIFICATE OF CORRECTION

PATENT NO. : 7,296,942 B2
APPLICATION NO. : 10/545876
DATED : November 20, 2007
INVENTOR(S) : Mayne It is certified that error appears in the above-identified patent and that said Letters Patent is hereby corrected as shown below:

Title page, insert the following:

--(30) Foreign Application Priority Data

Feb. 18, 2003 (GB) 0303670.4--.

Signed and Sealed this

Sixth Day of May, 2008

JON W. DUDAS
*Director of the United States Patent and Trademark Office*